US005107249A

United States Patent [19]

Johnson

[11] Patent Number: 5,107,249

[45] Date of Patent: Apr. 21, 1992

[54] INTRUSION DETECTION SYSTEM HAVING IMPROVED IMMUNITY TO FALSE ALARM

[75] Inventor: Richard A. Johnson, Roseville, Calif.

[73] Assignee: C & K Systems, Co., Folsom, Calif.

[21] Appl. No.: 598,124

[22] Filed: Oct. 16, 1990

[51] Int. Cl.[5] ..... G08B 13/00

[52] U.S. Cl. ..... 340/541; 340/522; 340/526

[58] Field of Search ..... 340/522, 526, 541, 550

[56] References Cited

U.S. PATENT DOCUMENTS 4,134,109 1/1979 McCormick ..... 340/550
4,668,941 5/1987 Davenport ..... 340/550
4,853,677 8/1989 Yarbrough et al. ..... 340/544
4,882,567 2/1989 Johnson ..... 340/522
4,928,085 5/1990 DuRand, III et al. ..... 340/544

*Primary Examiner*—Jin F. Ng
*Assistant Examiner*—C. Oda
*Attorney, Agent, or Firm*—Limbach & Limbach

[57] ABSTRACT

A multi-sensor intrusion detection system having improved immunity to false alarm is disclosed. The sensor being less susceptible to the generation of false alarm has its output signal processed and held. The held signal is supplied to a logic gate which receives directly the signal from the other sensor. The output of the logic gate generates an alarm signal.

14 Claims, 4 Drawing Sheets

INTRUSION DETECTION SYSTEM HAVING IMPROVED IMMUNITY TO FALSE ALARM

BACKGROUND OF THE INVENTION

The present invention relates to an improved intrusion detection system and more particularly to an intrusion detection system having a plurality of different types of sensors wherein one of the sensors is more susceptible to false alarm than the other. The intrusion detection system of the present invention provides for improved immunity to false alarm.

Intrusion detection systems having a plurality of detectors, detecting an intrusion as evidenced by different physical phenomenon, to improve immunity to false alarm is well-known in the art. Typically, for example, an intrusion detection system having a plurality of sensors comprises a passive infrared sensor, to detect infrared radiation, directed to detect intrusion in a volume of space and a microwave detector, to detect mass motion, directed to detect intrusion in the same volume of space. When a signal is generated by both of the sensors, the signal processing circuitry gates the signals and generates an alarm signal.

Another example of an intrusion detection system employing a plurality of sensors is disclosed in U.S. Pat. No. 4,853,677 (See also U.S. Pat. No. 4,928,085). There, a single microphone detects the audible sound of glass breaking and the subsonic sound of pressure on the glass being flexed. Here again, although a single microphone is used, two different types of physical phenomena are detected (audible sound waves and low frequency pressure waves) in order to provide the detection system with greater immunity to false alarm.

In all the intrusion detection systems of the prior art employing a plurality of sensors, the signal from each of the sensors is held for a period of time before they are brought together to be compared to determine if an alarm condition has occurred. This is because the detection of an intrusion causes a momentary pulse signal and the presence of the intrusion on both of the sensors may not occur simultaneously. Thus, it is desired in the prior art to "stretch" or hold each of the pulses received by each of the sensors.

While this has worked generally satisfactorily, the incidence of false alarm is still too high to be tolerated. False alarm can arise from the following example. Since the sensors detect different physical phenomena, each sensor is prone to generate false alarm differently from one another. Thus, for example, in a combination of passive infrared sensor with a microwave sensor, a microwave sensor can detect motions beyond a confined space contained by glass or sheetrock. Thus, a microwave sensor can extend beyond the desired coverage area, making it more susceptible to the generation of false alarm.

When one of the sensors of a multiple sensor intrusion detection system is more susceptible to false alarm than the other, i.e. the sensor generates more detected sensing pulses than the other, the immunity to false alarms of the entire system is reduced. This occurs because if, for example, one of the sensors, the one that is more susceptible to false alarm, is frequently generating alarm signals, then because the signal is being held by the holding circuitry, the time period in which that sensor is on is virtually a constant. Then, if another type of physical activity triggers a false alarm in the second sensor, this would create a false alarm in the entire system.

Accordingly, in the present invention, an improved intrusion detection system having a plurality of sensors which is more immune to false alarm generation is disclosed.

U.S. Pat. No. 4,882,567, discloses an intrusion detection system having a plurality of sensors. The reference discloses the use of one type of sensor to detect an intrusion then activating the second type of sensor. The purpose of this device is to decrease power consumption in a multi-sensor detection system. Because the second inactive sensor is not on, the detection signal from the first sensor must be held for an inordinate amount of time (on the order of more than ten seconds) in order to insure that by the time the inactive sensor is activated, the signal from the activating sensor would still be held to be compared to the signal from the activated sensor.

SUMMARY OF THE INVENTION

In the present invention, a multiple sensor intrusion detection system is disclosed. The system has a first detecting means for detecting an intrusion in a volume of space and generating a first signal in response to the detection of the intrusion. The first signal can have one of two possible states: a first state representative of detection of the representative of the detection of the absence of the intrusion. A second detecting means detects an intrusion in the same volume of space and generates a second signal in response to the detection of the intrusion. The second signal can also have one of two possible states: a first state representative of detection of the presence of the intrusion and a second state representative of the detection of absence of the intrusion. The second detecting means is less susceptible to false alarm than the first detecting means. A signal holding means holds the second signal and produces a held second signal. A logic means receives directly the first signal and directly the held second signal and generates an alarm signal in response to the first signal being in the first state and the held second signal being in the first state.

DETAILED DESCRIPTION OF THE DRAWINGS

Figure 1A:
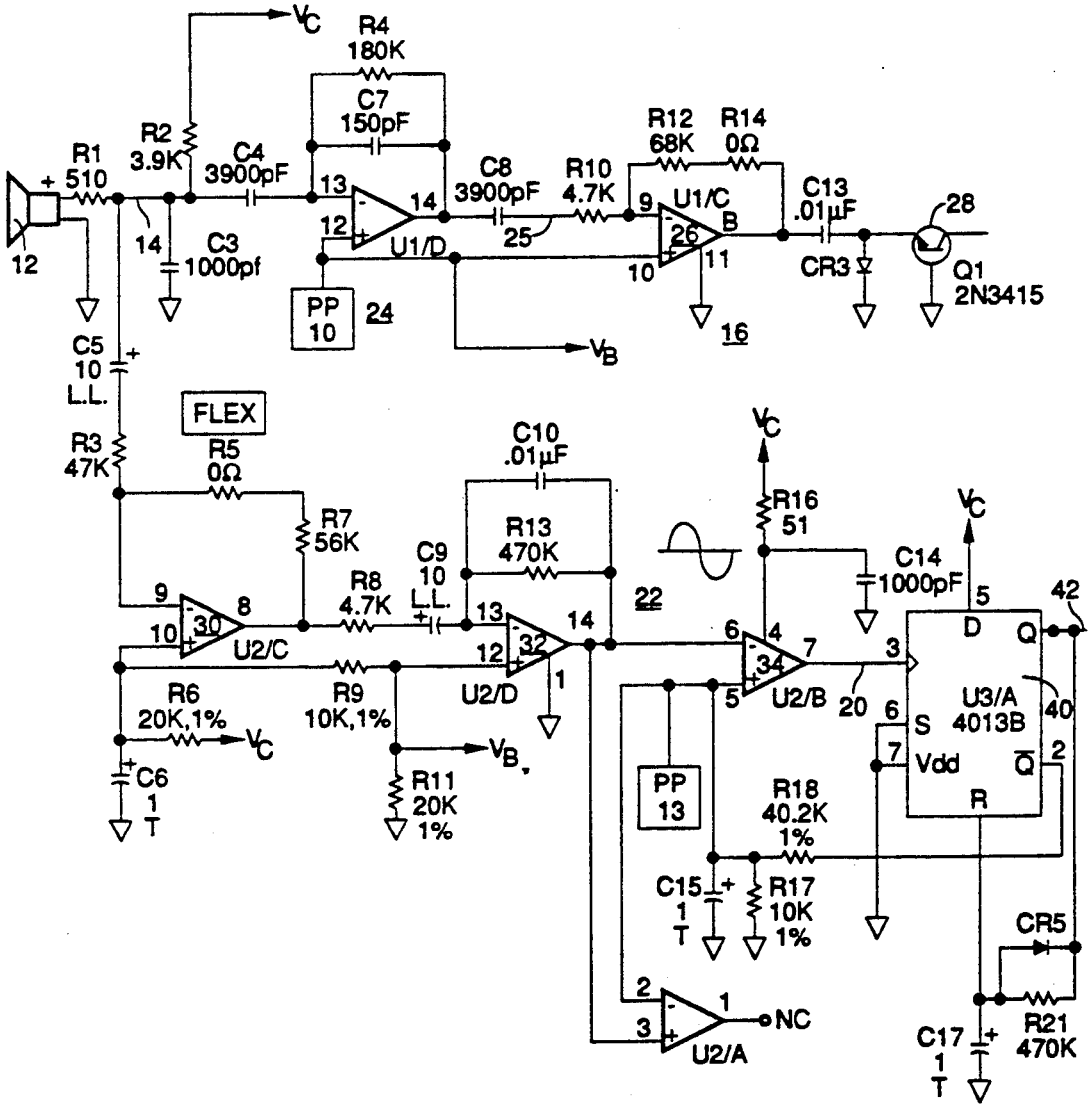
FIGS. 1*a* and 1*b* are circuit diagrams of the improved detection system of the present invention.
Figure 1B:
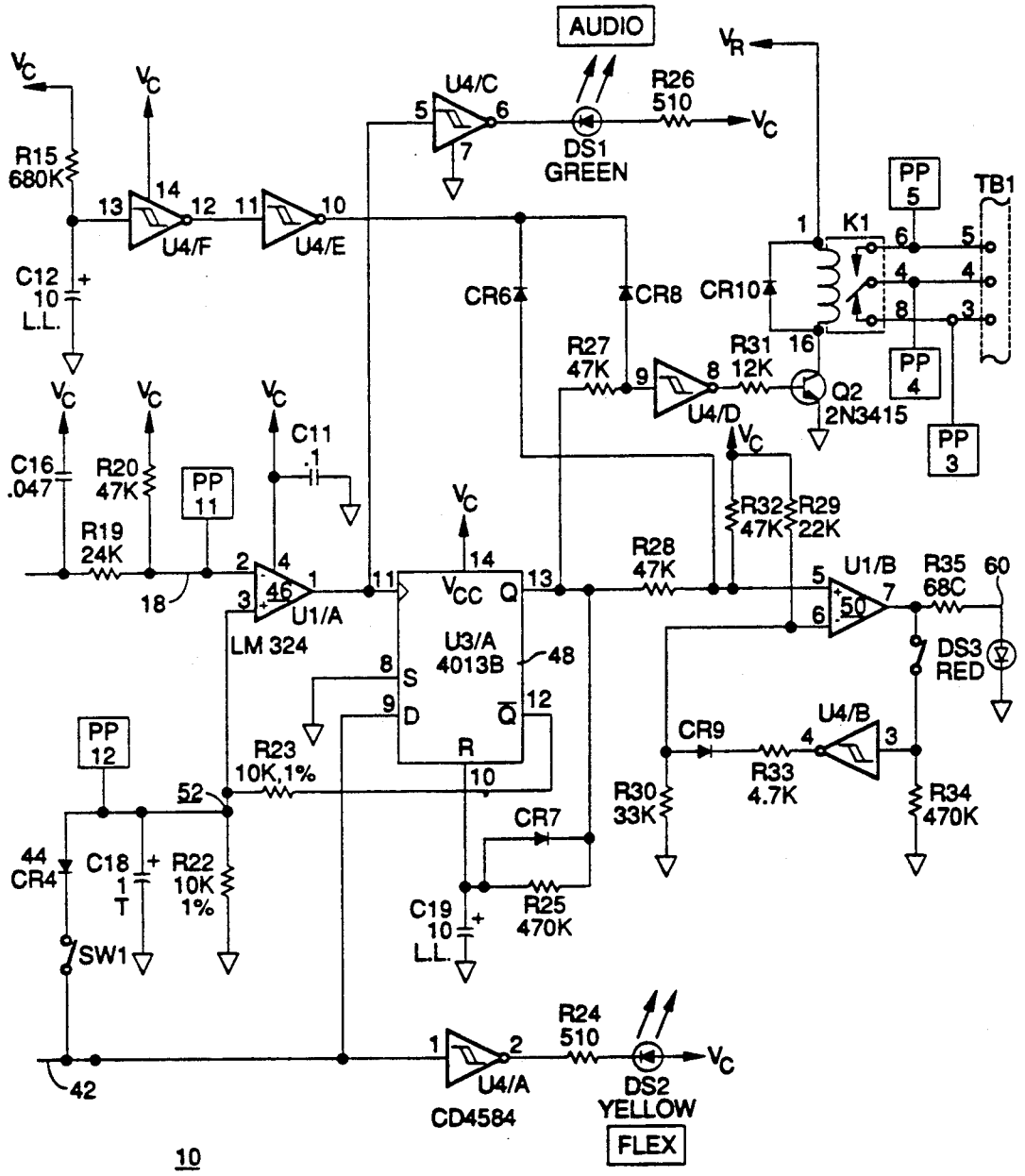

Referring to FIG. 1 there is shown a circuit diagram of an intrusion detection system 10 of the present invention. The system 10 comprises a microphone 12 which generates an output signal 14. The output signal 14 is supplied to an audio signal processing circuit 16 to produce an audio output signal 18. The output signal 14 is also supplied to a flex signal processing circuit 22 to produce a flex output signal 20. The audio output signal 18 and the flex output signal 20 are two signals representing the detection of intrusion in the same volume of space caused by two different physical phenomena.

As will be apparent to those skilled in the art, although a single microphone sensor 12 is used to generate the audio output signal 18 and the flex output signal 20, the invention described herein is applicable to an intrusion detection system 10 using multiple different sensors such as a passive infrared produce two different output signals.

The audio signal processing circuit 16 is well known in the art and comprises a filter/amplifier signal circuit 24 which receives the output signal 14 and filters it and amplifies it in the sonic range. From the filter/amplifier signal circuit 24 a filtered audio signal 25 is produced. The filtered audio signal 25 is then supplied to an amplifier 26. From the amplifier 26, the signal is then supplied to a negative peak detector 28. The output of the negative peak detector 28 is then supplied to a level shifter comprising of the resistor R19 and R20 to produce the audio output signal 18. The audio output signal 18 has the characteristics that if an intrusion has occurred, the signal has a voltage level of $V_c/3$. If an intrusion has not occurred, the signal would have a voltage of $V_c$.

The output signal 14 from the microphone 12 is also supplied to the flex signal processing circuit 22. The flex signal processing circuit 22 comprises a filter/amplifier signal processing circuit 30 which filters and amplifies the subsonic frequency of the output signal 14. From the filter processing signal circuit 30, the flex signal is provided to an amplifier 32. The output of the amplifier 32 is supplied to a negative pulse detector 34 which generates the flex output signal 20.

In the system 10 of the present invention, in the environment in which the system 10 is to operate, the detection of an intrusion by the flex output signal 20 is less susceptible to false alarm than the detection of an intrusion by the audio output signal 18. Thus, the flex output signal 20 is supplied to the clock input of a first register 40. The D input of the first register 40 is held at high voltage $V_c$. If an intrusion is detected by the flex signal processing circuit 22, the flex output signal 20 would have a voltage of V, and would cause the Q output 42 of the first register 40 to be at the voltage of $V_c$. If no intrusion is detected by the flex signal processing circuit 22, the flex output signal 20 would have a voltage of zero and would cause the Q output 42 of the first register 40 to be at ground.

The Q output 42 of the first register 40 is then supplied to a switch SW1 which is open during installation and adjustment. The switch SW1 is closed during normal operation. The Q output 42 is then supplied to a back biased diode 44. The anode of the diode 44 is at a node 52, which is supplied to the positive input of a comparator 46. The node 52 is also connected to a resister R22 in parallel with a capacitor. Resistor R22 has a resistance of approximately 10K. Capacitor C18 has a capacitance of approximately 1 micro farad. In addition, the node 52 is connected to a resistor R23 (which has a resistance of approximately 10K) which is connected to the $\overline{Q}$ output of a second register 48.

The audio output signal !8 is supplied to the negative input of the comparator 46. The output of the comparator 46 is supplied to the clock input of the second register 48. The D input of the second register 48 is connected to the Q output 42 of the first register 40. The Q output of the second register 48 is then supplied through an operational amplifier 50 and is supplied as the alarm signal 60.

The operation of the system 10 will now be described as follows: As previously discussed, in the event the audio signal processing circuit 16 detects the presence of an intruder, the audio output signal 18 would have a voltage on the order of $V_c/3$. In the event the audio signal processing circuit 16 detects the absence of an intrusion, the audio output signal 18 would have a voltage of on the order of $V_c$. The flex processing circuit 22 generates a flex output signal 20 which is on the order of ground in the absence of detection of an intrusion. The flex processing circuit 22 generates the flex output signal 20 which is on the order of $V_c$ in the event an intrusion is detected.

In the event the flex output signal 20 is low, the Q output 42 of the first register 40 would be low, on the order of ground voltage. Switch SW1 would be connected. Diode 44 would conduct. Node 52 would have a voltage on the order of +0.7 volts. This is the forward conduction voltage of the diode 44. The node 52 being at approximately +0.7 volts is supplied to the positive input of the comparator 46. Since in both conditions, i.e. detection of the presence of an intrusion and the detection of the absence of an intruder, the audio output signal 18 would always be greater than +0.7 volts, the output of the comparator 46 would be low. Therefore, irrespective of the detection of the presence or absence of an intrusion by the audio signal processing circuit 16, the output of the comparator 46 would be low. The Q output of the second register 48 would also be low. This would prevent an alarm signal 60 to be generated.

The alarm signal 60 is generated only when the flex output signal 20 goes high. This is then clocked into the first register 40. The Q output 42 of the first register 40 would be high, on the order of +5 volts. With the $\overline{Q}$ output of the second register 48 high (Q is low because there is no alarm), the resistor divider comprising of resistor R23 and R22 would maintain node 52 at approximately 2.5 volts. With the Q output 42 at approximately 5 volts, diode 44 would be reversed biased. Therefore, approximately +2.5 volts would be supplied to the plus input of the comparator 46.

If the audio signal processing circuit 16 detects the absence of an intrusion, the audio output signal 18 would be approximately $V_c$ or +5 volts. In this condition, the output of the comparator 46 would still remain low. This would keep the Q output of the second register 48 low. This will result in no alarm signal 60 being generated.

However, if the audio signal processing circuit 16 detects the presence of an intrusion, the audio output signal 18 would have approximately $V_c/3$ volts or approximately 1.67 volts. Since the plus input of the comparator 46 is greater than the negative input, the output of the comparator 46 would be high. This would be clocked into the second register 48. The Q output of the second register 48 would then go high. An alarm signal 60 would then be generated.

Figure 5:
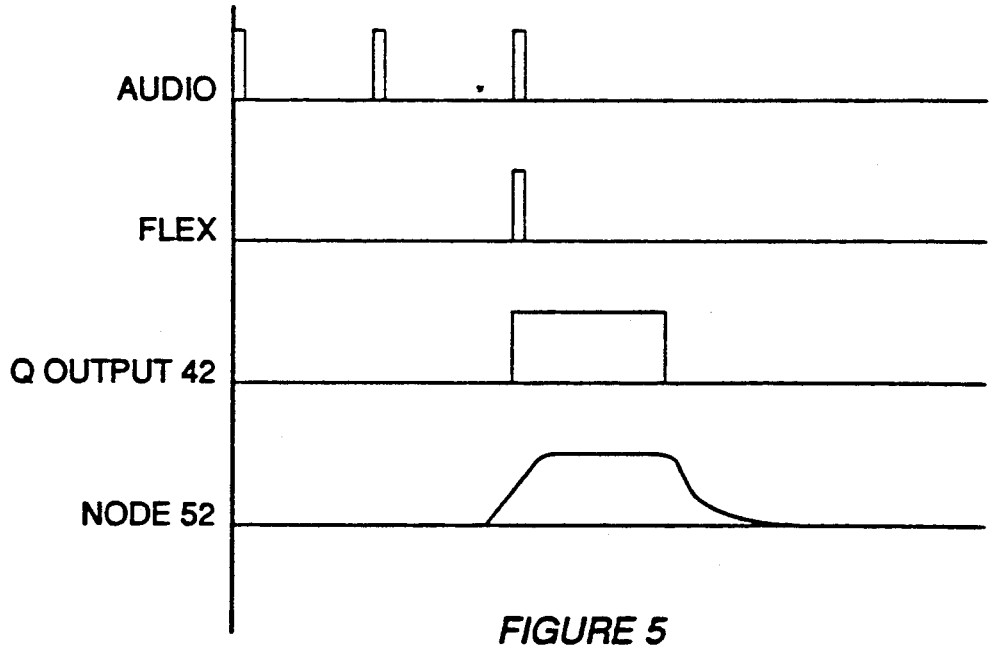
FIG. 5 is a timing diagram of the logic circuit portion of the intrusion detection system of the present invention.

In another aspect of the system 10 of the present invention, the resistor R22 and the capacitor C18 provides further immunity to false alarms. This can be seen by reference to FIG. 5. The audio channel of the system 10 is shown as being "noisy", i.e. producing a number of false alarms. FIG. 5 shows an example of when an audio output signal 18 is produced at the same time as a flex output signal 20. This can be caused, for example, by the false alarm condition of someone slamming a drawer. The change in the air pressure caused by the movement of the drawer is detected by the flex processing circuit 22. The noise of the sound of the closing of the drawer is detected by the audio signal processing circuit 16. The audio output signal 18 and the flex output signal 20 are then produced simultaneously.

The Q output 42 from the first register 40 is also shown as stretching or holding the flex output signal 20. However, because of the capacitor C18 and the resistor R22, the signal at the node 52 is time shifted or delayed by an amount which is the time constant of R22 and capacitor C18. The result is that by the time the delayed signal from the node 52 is supplied to the comparator 46, the audio output signal 18 is no longer present Thus, the comparator 46 would not generate a high signal. This would then cause no alarm signal 60 to be generated.

In contrast, were there an actual presence of an intrusion caused by the breaking of glass, the flex signal processing circuit 22 would generate a flex output signal 20 prior to the audio signal processing circuit 16 generating an audio output signal 18. With a delay in the Q output 42 of the first register 40, the delayed held signal from the first register 40 at node 52 would be coincident with the audio output signal 18, thereby giving rise to an alarm signal 60.

Figure 2:
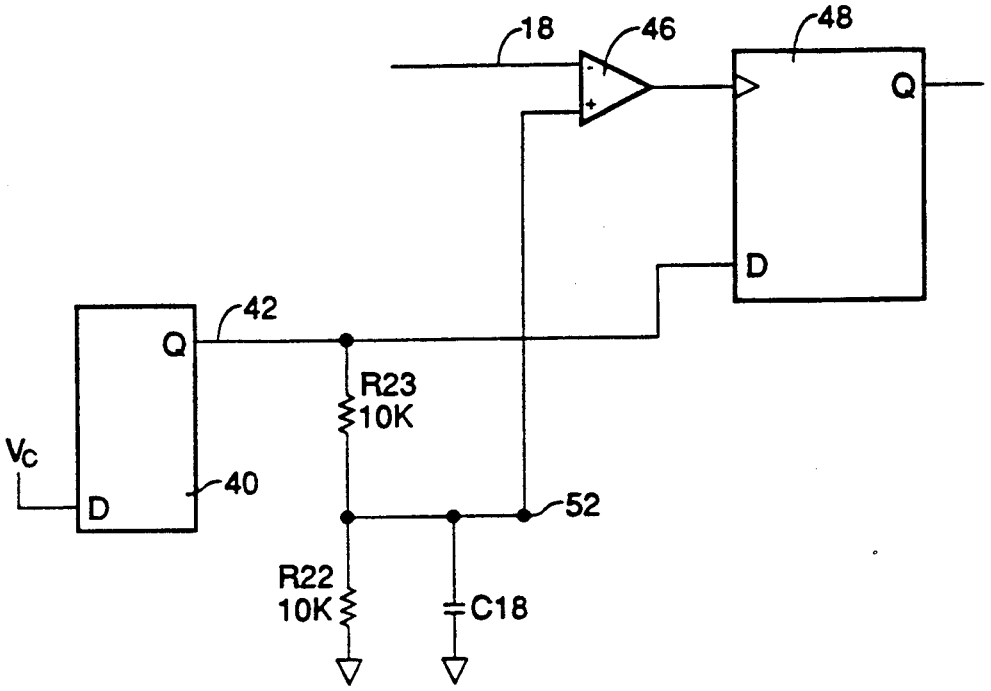
FIG. 2 is a circuit diagram of another embodiment of the logic circuit portion of the intrusion detection system of the present invention.

Referring to FIG. 2, there is shown another embodiment of a portion of the logic circuit of the system 10 of the present invention. The Q output 42 of the first register 40 is supplied to the D input of the second register 48. The Q output 42 is also connected to a first resistor R23 to the node 52. Node 52 is connected to a second resistor 22 and capacitor C18, which are connected in parallel. Node 52 is also supplied to the positive input to the comparator 46.

In the embodiment shown in FIG. 2, in the event the Q output 42 is at +5 volts, node 52 would reach approximately 2.5 volts after a period of delay caused by the time constant of R22 and C18. In the event the Q output 42 is at 0 volts, the node 52 would be approximately at 0 volts. The embodiment shown in FIG. 2 differs from the embodiment in FIG. 1 in that the diode 44 is not used.

Figure 3:
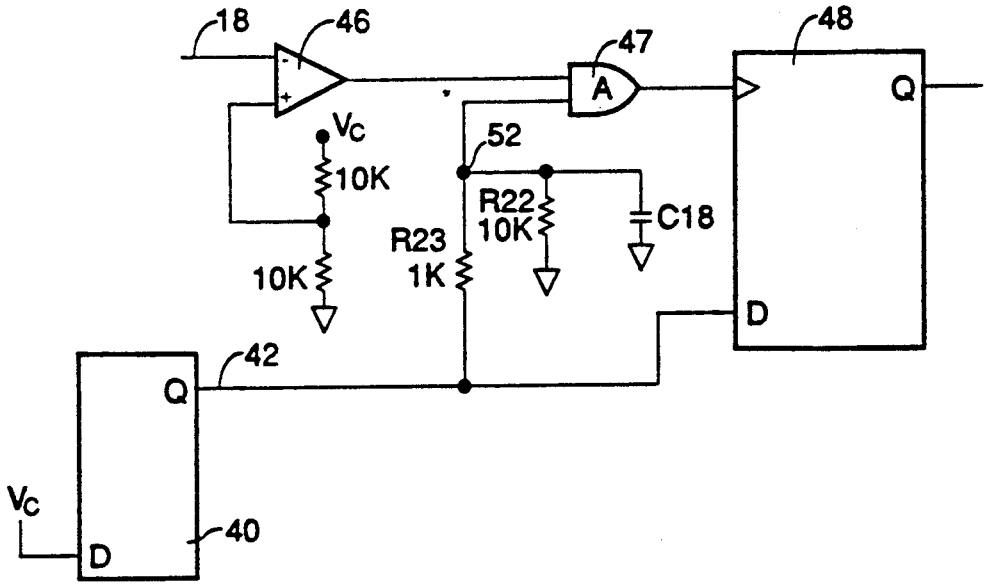
FIG. 3 is a circuit diagram of yet another embodiment of the logic circuit portion of the intrusion detection system of the present invention.

Referring to FIG. 3 there is shown yet another embodiment of the logic circuit portion of the system 10 of the present invention. The audio output signal 18 is supplied to a comparator 46 at the negative input thereof. The positive input of the comparator 46 is supplied with a substantially constant voltage of approximately 2.5 volts. This is provided by a voltage divider. The output of the comparator 46 is supplied to one input of an AND gate 47. If the audio output signal 18 is $V_c/3$ indicating the presence of an intruder, the output of the comparator 46 would be high. If the audio output signal 18 is $V_c$ indicating the absence of an intrusion, the output of the comparator 46 would be low.

The Q output 42 of the first register 40 is supplied through a resistor R23 to a node 52. The node 52 is also connected to resistor R22 and capacitor C18 in parallel as previously described. However, the resistive value of R23 is approximately 1K. Node 52 is supplied as another input to the AND gate 47. The output of the AND gate 47 is supplied to the clock input of the second register 48.

In the operation of the embodiment shown in FIG. 3, the first input to the AND gate 47 (output of the comparator 46), would be either high or low, depending upon the presence or absence of the detection of intrusion. The Q output 42 of the first register 40 is passed through the first resistor R23 to node 52. Since resistor R23 is in series with R22, node 52 would have a drop of approximately 0.1 $V_C$. Therefore, node 52 would have approximately +4.5 volts when the Q output 42 is high. In that event, the output of the AND gate 47 would be high. On the other hand, if the Q output 42 of the first register 40 is low, node 52 would be low. The output of the AND gate 47 would be low resulting in the Q output of the second register 48 being low.

Figure 4:
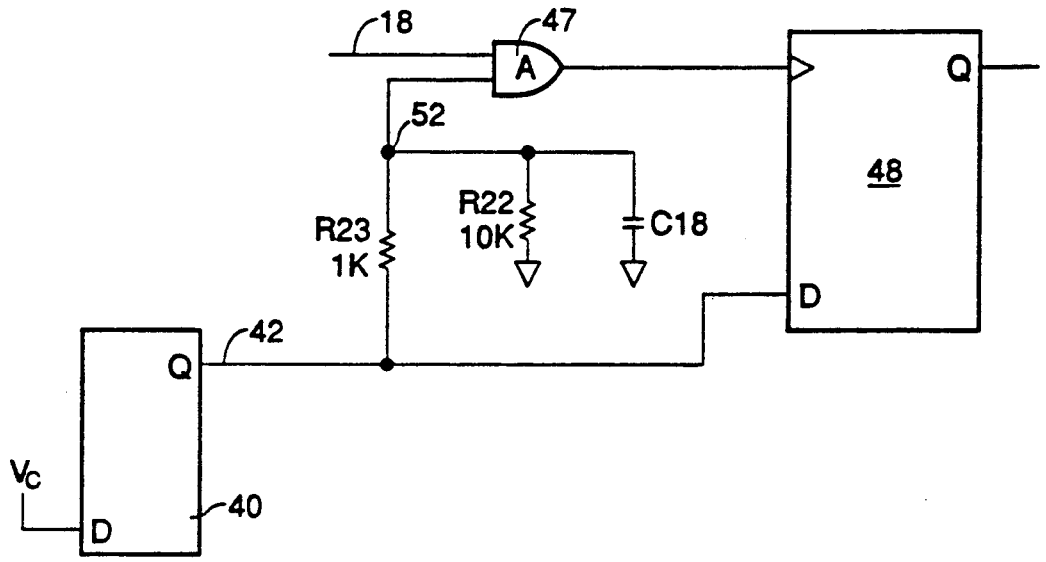
FIG. 4 is a circuit diagram of still yet another embodiment of the logic circuit portion of the intrusion detection system of the present invention.

Referring to FIG. 4, there is shown still yet another embodiment of the logic processing circuit of the system 10. The embodiment shown in FIG. 4 is similar to the embodiment shown in FIG. 3 except that the audio output signal 18 is $V_c$ if the audio signal processing circuit 16 detects the presence of an intrusion. The audio output signal 18 is ground voltage if the audio signal processing circuit 16 detects the absence of an intrusion. Thus, the audio output signal 18 is high in the presence of an intrusion and is low in the absence of an intrusion. This is supplied to AND gate 47.

The Q output 42 of the first register 40 is high in the presence of an intrusion and is low in the absence of an intrusion. The Q output 42 is supplied through resistor R23 (of approximately 1K in resistance) to node 52. Node 52 is connected to resistor R22 (10K) and capacitor C18 (1 micro farad) in parallel therewith. Node 52 is also supplied as another input to the AND gate 47. Again, similar to the other embodiments shown and described, in the event the Q output 42 is high indicating the detection of the presence of an intrusion by the flex signal processing circuit 22, the Q output 42 is supplied through the resistor R23 to the node 52. Node 52 would have approximately 4.5 volts. However, because node 52 has a resistor R22 and the capacitor C18 connected therewith, an RC circuit is formed thereby delaying the Q output 42. The delayed Q output 42 is then supplied to the AND gate 47. AND gate 47 produces a signal only if the delayed held flex output signal 18 is coincident with the audio output signal 18.

There are many advantages to the apparatus of the present invention. First and foremost is that is provides greater immunity to false alarm. In addition, with the signal processing circuitry employed, false alarm is yet further reduced.

What is claimed is:

1. An intrusion detection system comprising:

a first detecting means for detecting an intrusion in a volume of space by a first physical phenomenon and for generating a first signal in response to the detection of said intrusion, said first signal being in one of two possible states, a first state representative of detection of presence of said intrusion and a second state representative of detection of absence of said intrusion;

a second detecting means for detecting an intrusion in said volume of space by a second physical phenomenon, different from the first phenomenon for generating a second signal in response to the detection of said intrusion, said second signal being in one of two possible states, a first state representative of detection of presence of said intrusion and a second state representative of detection of absence of said intrusion;

said second detecting means being less susceptible to false alarm than said first detecting means;

first signal holding means for holding said second signal and for producing a held second signal; and logic means for receiving directly said first signal and directly said held second signal and for generating an alarm signal in response to said first signal being in said first state and said held second signal being in said first state.

2. The system of claim 1 wherein said first signal holding means is a register.

3. The system of claim 1 further comprising:

second signal holding means for receiving said alarm signal and for holding said alarm signal.

4. The system of claim 1 wherein said logic means further comprising:

means for delaying said held second signal.

5. The system of claim 4 wherein said delaying means comprises a resistor-capacitor circuit.

6. The system of claim 1 wherein said logic means comprises:

a comparator means having two inputs, a first input for receiving said first signal; and means for receiving said held second signal and for processing said held second signal to produce a processed second signal and for providing same to said second input of said comparator means.

7. The system of claim 6 wherein said processing means further comprising:

means for delaying said held second signal.

8. The system of claim 7 wherein said delaying means comprises a resistor-capacitor circuit.

9. The system of claim 1 wherein said logic means comprises:

a comparator means having two inputs, a first input for receiving said first signal and a second input for receiving a reference signal and for producing a compared first signal;

gate means having two inputs, a first input for receiving said compared signal; and means for receiving said held second signal and for processing said held second signal to produce a processed second signal and for providing same to said second input of said gate means.

10. The system of claim 9 wherein said processing further comprising:

means for delaying said held second signal.

11. The system of claim 10 wherein said delaying means comprises a resistor-capacitor circuit.

12. The system of claim 1 wherein said logic means comprises:

gate means having two inputs, a first input for receiving said first signal; and means for receiving said held second signal and for processing said held second signal to produce a processed second signal and for providing same to said second input of said gate means.

13. The system of claim 12 wherein said processing further comprising:

means for delaying said held second signal.

14. The system of claim 13 wherein said delaying means comprises a resistor-capacitor circuit.

* * * * *

UNITED STATES PATENT AND TRADEMARK OFFICE

CERTIFICATE OF CORRECTION

PATENT NO. : 5,107,249

DATED : April 21, 1992

INVENTOR(S) : Richard A. Johnson

It is certified that error appears in the above - identified patent and that said Letters Patent is hereby corrected as shown below:

Col. 3, line 64, delete "!8", and insert --18--.

Signed and Sealed this

Sixth Day of July, 1993

*Attest:*

Michael K. Kirk

MICHAEL K. KIRK

*Attesting Officer*

*Acting Commissioner of Patents and Trademarks*